United States Patent [19]

Mears

[11] Patent Number: 4,579,401

[45] Date of Patent: Apr. 1, 1986

[54] COLLAPSIBLE CABINET

[76] Inventor: Joyce L. Mears, 1338 Potomac School Rd., McLean, Va. 22101

[21] Appl. No.: 620,713

[22] Filed: Jun. 14, 1984

[51] Int. Cl.[4] ..... A47B 43/00

[52] U.S. Cl. ..... 312/258; 312/262

[58] Field of Search ..... 312/258, 259, 262, 108, 312/111; 108/11, 38, 41

[56] References Cited

U.S. PATENT DOCUMENTS

| | | | |
|---|---|---|---|
| 168,879 | 10/1875 | Colbert | 312/258 |
| 274,418 | 3/1883 | Van Hutton | 312/258 |
| 1,128,031 | 2/1915 | Needleman | 312/258 |
| 2,475,513 | 7/1949 | Peckinpaugh | 312/258 |
| 2,515,876 | 7/1950 | Kauffman | 312/258 |
| 3,294,307 | 12/1966 | Munroe | 312/258 |
| 3,407,941 | 10/1968 | Schmidt | 312/258 |
| 3,583,781 | 6/1971 | Yamawaki | 312/258 |
| 3,797,905 | 3/1974 | Naske | 312/262 |
| 4,065,195 | 12/1977 | Fahmie | 312/258 |
| 4,099,809 | 7/1978 | Leotta | 312/258 |

FOREIGN PATENT DOCUMENTS

| | | | |
|---|---|---|---|
| 261318 | 5/1949 | Switzerland | 312/258 |

*Primary Examiner*—Victor N. Sakran
*Attorney, Agent, or Firm*—Millen & White

[57] ABSTRACT

A cabinet which is collapsible from an erect condition to a collapsed condition includes a base panel to which are hinged first and second side panels and a front panel extending perpendicular to the first and second side panels. Each of the panels is hinged to a progressively higher flange so that the panels collapse over one another in an overlapping relationship. The front panel is hinged intermediate its ends and folds back upon itself. A top panel forming a top for the cabinet is hinged to the front panel and overlies the first and second side panels and folded front panel when the cabinet is collapsed. The cabinet includes at least one shelf which can be stored beneath the collapsed sides and front. Castors are provided so that the cabinet may be conveniently moved when either erected or collapsed.

5 Claims, 7 Drawing Figures

COLLAPSIBLE CABINET

BACKGROUND OF THE INVENTION

1. Field of the Invention

The instant invention relates to collapsible cabinets, and more particularly the instant invention relates to collapsible cabinets which are portable and particularly suitable for displays as well as other uses.

2. General Considerations and Prior Art

People and organizations which participate in trade fairs, exhibits, conferences, meetings and the like frequently have need of cabinets and tables upon which to store and display various materials. In addition, businesses such as catering services and beverage dispensing services frequently need cabinets and carts which must be transported to a variety of locations for use during relatively short periods of time and then returned for storage and subsequent use. These types of cabinets and carts consume a great deal of space while they are being transported and stored. Since space or volume must be paid for during storage and transport, carts and cabinets must be paid for even when they are not serving their intended purpose. In many businesses and endeavors where carts and cabinets are used periodically, the carts and cabinets spend most of their time in storage and transport. Accordingly, these types of devices can carry considerable expense even when not being used for their intended purpose. In addition, carts and cabinets can be quite cumbersome and dfficult to handle due to their considerable volume and relatively large dimensions. This requires additional personnel which also adds to the expense of utilizing such devices.

The prior art does not disclose a foldable cabinet for use by exhibitors, caterers, beverage dispensers, or the like, which is readily collapsed for storage and transport and yet has a standard, cabinet-like configuration when in use.

SUMMARY OF THE INVENTION

In view of the aforementioned considerations, the instant invention contemplates a collapsible cabinet comprising a base panel having flanges projecting from the top side thereof and rollers, such as wheels or castors, secured to the bottom side thereof. The three flanges are of different heights and have hinged thereto panels which form opposed sides and a front for the cabinet. The opposed sides fold toward the base panel in overlapping relationship with one another and the front panel collapses over the sides. A top panel is hinged to the front panel to form a top for the cabinet when the cabinet is erected. When the cabinet is collapsed, the top panel rests upon the folded front panel and collapsed side panels to form a compact package. At least one intermediate shelf may be utilized and is stored parallel with and beneath the collapsed members.

DESCRIPTION OF THE PREFERRED EMBODIMENT

Figure 1:
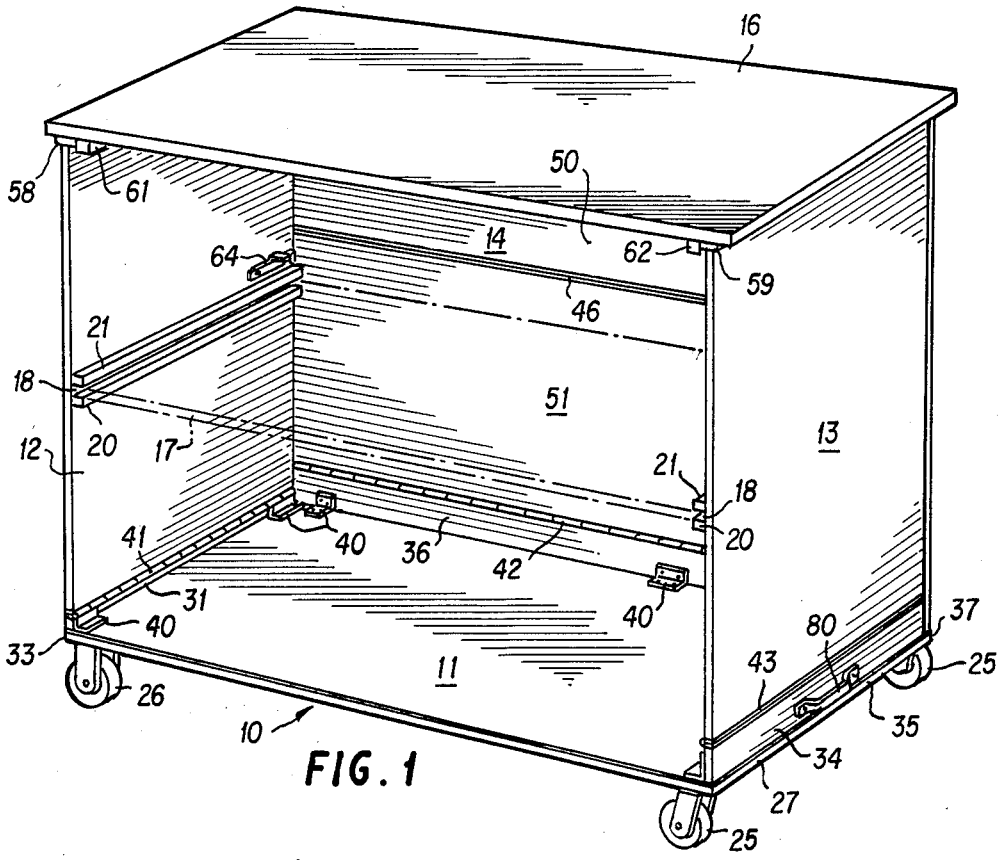
FIG. 1 is a perspective view of the collapsible cabinet in accordance with the instant invention shown in erected position.

Referring now to FIG. 1, there is shown a collapsible cabinet, designated generally by the numeral 10, in accordance with the instant invention. The cabinet 10 includes a base panel 11 which forms the floor of the cabinet, a first side panel 12 which forms the left side of the cabinet, a second side panel 13 which forms the right side of the cabinet, a front panel 14 which encloses the front of the cabinet and a top panel 16 which forms the top of the cabinet. In accordance with the disclosed embodiment, the rear of the cabinet 10 is open. The cabinet 10 has two configurations, i.e. the erected configuration of FIG. 1 and the collapsed configuration of FIG. 4.

Figure 2:
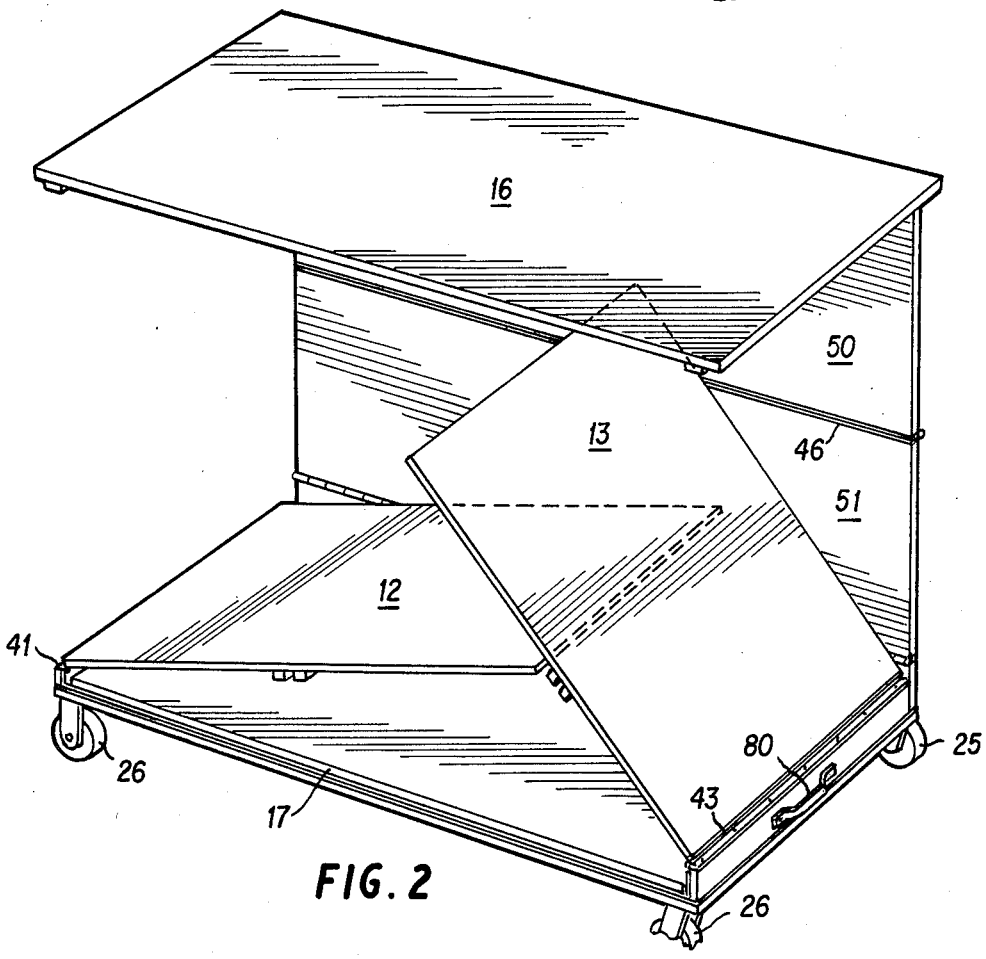
FIG. 2 a perspective view of the collapsible cabinet of the instant invention showing side panels being folded toward a base panel and a shelf stored on the base panel.

Cabinet 10 preferably includes a shelf 17 which is slidably introduced between the first and second side panels 12 and 13. The shelf 17 is retained in slot 18 defined by pairs of ribs 20 and 21 which are secured to the side panels 12 and 13 by screws or the like. When the cabinet is collapsed the shelf 17 is stored beneath the sides 12, 13, and 14 (see FIGS. 2 and 4).

Figure 4:
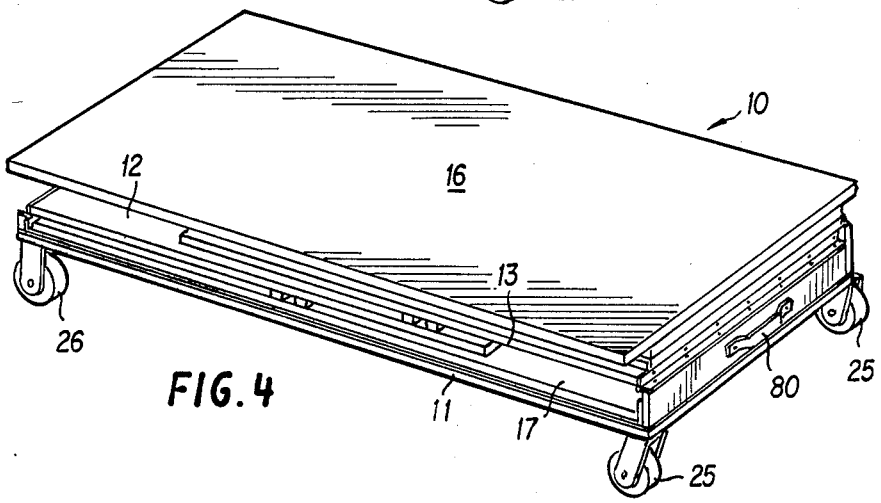
FIG. 4 is a perspective view showing the cabinet of the instant invention in its collapsed position.

In order to facilitate movement of the cabinet 10 when it is either in the erect configuration of FIG. 1 or the collapsed configuration of FIG. 4, two pairs of casters 25 and 26 are secured to a frame 27 which is L-shaped in cross section and surrounds the base 11. Preferably, one pair of the casters is rigid while the other pair swivel and brake.

To further facilitate movement of the cabinet 10, particularly in the collapsed configuration of FIG. 4, a handle 80 or other suitable carrying means may be provided adjacent one or both of side panels 12 and 13.

The base panel 11 has a first flange 31 fixed at one side edge 33 thereof, a second side flange 34 at a second side edge 35 thereof, and a third flange 36 along a front edge 37 thereof. As is apparent from the drawings, first flange 31 is lower than second flange 34 and the second flange 34 is lower than the third flange 36. Each of the flanges is secured to the base panel 11 by rigid, strong, L-shaped brackets 40 so as to remain fixed and rigid with respect to the base panel. First, second, and third continuous hinges such as piano hinges 41, 42, and 43 respectively, are secured to the tops of the first, second, and third flanges 31, 34, and 36 respectively. The first, second, and third panels 12, 13, and 14 respectively are secured to the top leaves of the hinges 41, 42, and 43 respectively. Each of the hinges 41, 42, and 43, respectively, are oriented with the hinge pins inside of the cabinet 10 so that the side panels 12 and 13 and the front panel 14 can pivot toward the base panel 11 (see FIG. 2).

Figure 6:
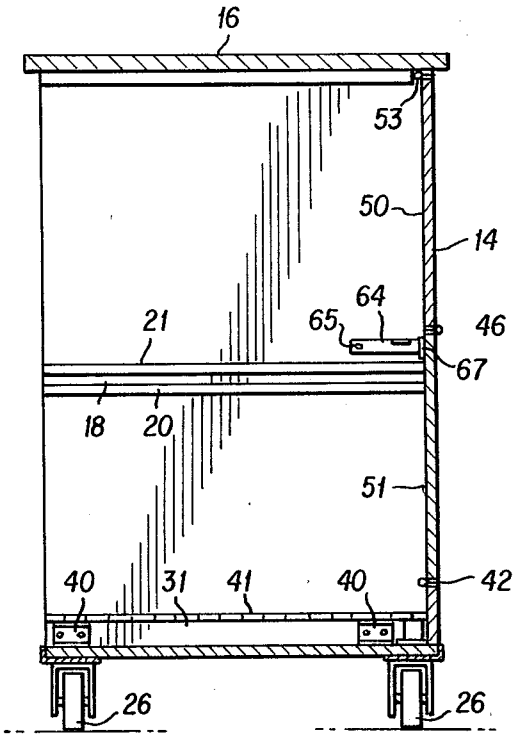
FIG. 6 is cross-section of the cabinet taken along Lines 6—6 of FIG. 5.
Figure 5:
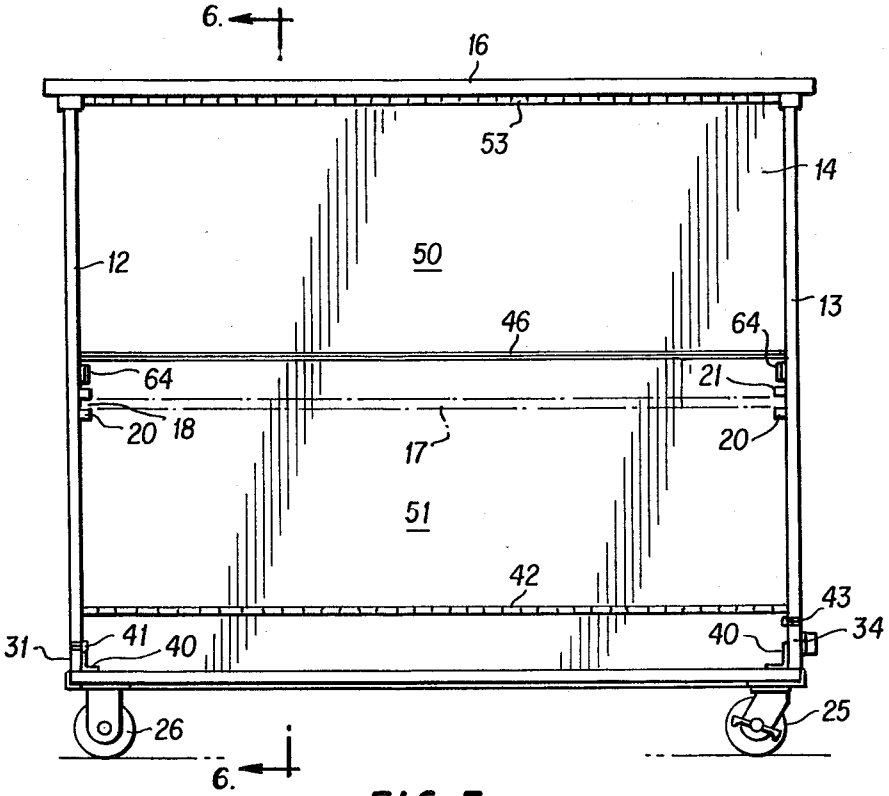
FIG. 5 is a view of the collapsible cabinet in accordance with the instant invention from the back thereof.

The front panel 14 which forms a third side panel has a continuous hinge such as piano hinge 46 intermediate its ends dividing it into upper and lower panel portions 50 and 51. The hinge 46 has its hinge pin on the exterior of the cabinet 10 so that as the lower panel portion 51 folds toward the base panel 11, the upper panel portion 50 will fold toward the base panel 51 (see FIG. 3). As is seen in FIGS. 5 and 6, the top panel 16 is pivoted to the top panel portion 50 by a hinge 53 which has its pivot pin 54 is the interior of the cabinet so that the top panel 16 folds toward the interior surface of the upper panel portion 50. The panel portions 51, 50, an the top panel 16 form a single foldable unit hinged at hinge 42.

Figure 7:
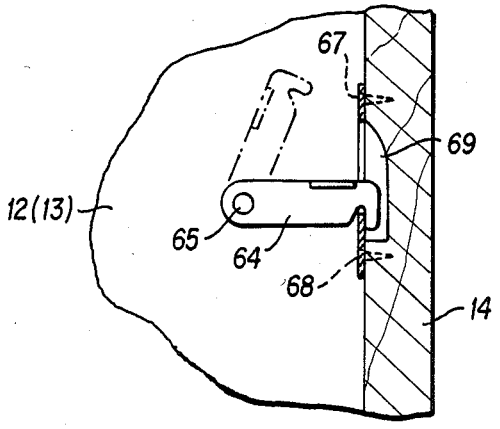
FIG. 7 a sectional view showing operation of a latch used for holding the side panels latched to the front panel when the cabinet is erected.

In order to retain the rigidity of the erected cabinet 10 shown in FIG. 1, the side panels 12 and 13 have abutments 58 and 59 which engage braces 61 and 62 exposed on the bottom surface of top panel 16. Engagement of the abutments 58 and 59 with the braces 61 and 62 in combination with abutment of the shelf 17 with the inside surfaces of side panels 12 and 13 keeps the side panels 12 and 13 from collapsing inwardly when the cabinet 10 is erect. In addition, latches 64 (see FIG. 7) are pivoted by pins 65 to the inside surfaces of panels 12 and 13 for engagement with keepers 67 on the inside surface of the front panel 14. The keepers 67 are formed by securing metal plates 68 with openings 69 therethrough over recesses 70 in the front panel. This engagement keeps the side panels 12 and 13 from tending to lean outwardly with respect to the interior of the cabinet 10 and keeps the abutments 58 and 59 in engagement with the braces 61 and 62. Consequently, a rigid, erect cabinet 10 is provided.

Figure 3:
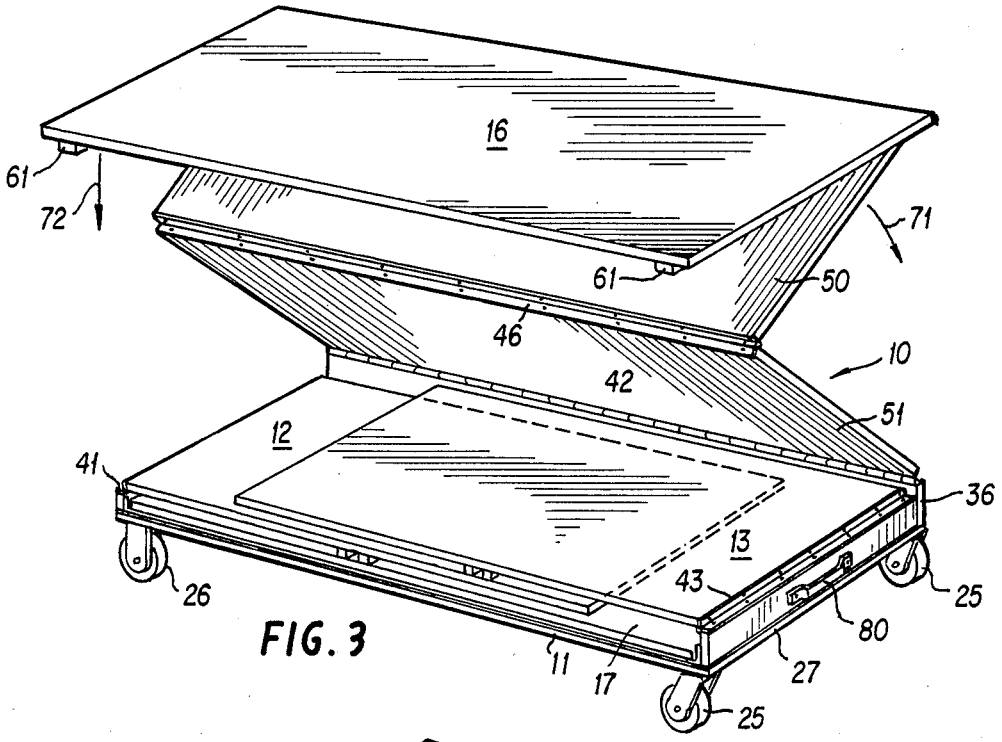
FIG. 3 is a perspective view of the cabinet in accordance with the instant invention showing the back panel being folded upon itself and collapsed down upon the previously collapsed side panels.

In order to collapse the erect cabinet 10 from the FIG. 1 configuration to the FIG. 4 configuration, the shelf 17 is removed from the slot 18 and placed on the base 11. The latches 64 are then released by being pivoted upwardly so as to allow the side panels 12 and 13 to fold inwardly toward one another. Since the side panel 12 is mounted on the lowest flange 31 it is pivoted first over the base panel 11. If the cabinet 10 is relatively large, it can be laid on its side or front during the collapsing process so that one is not confronted with the full weight of top panel 16 and front panel 14 while folding them. As is seen in FIG. 3, the side panel 12 when folded lies beneath the top of the second flange 34 at the opposite edge 35 of the base panel 11. The second side panel 13 is then folded over the first side panel 12. As is readily seen in FIGS. 2—4, the side panels 12 and 13 each have a length which is less than the length of the bottom panel 11. After the side panel 13 has been folded over the side panel 12, the front panel 14 is free to fold over the side panel 13.

As is seen in FIG. 3, after the first and second sides 12 and 13 are folded to lie substantially parallel over the base panel 11, the front panel 14 is collapsed in accordian fashion. In other words, the lower panel portion 51 of front panel 14 pivots inwardly toward the base panel portion 11 in the direction of arrow 70, the upper panel portion 50 pivots in the direction of the arrow 71 and the top panel 16 moves downwardly in the direction of the arrow 72. The entire structure thereafter nests together as is shown in FIG. 4. If desired, straps (not shown) may be placed around the collapsed cabinet 10 to secure the cabinet in its collapsed configuration.

In order to erect the cabinet 10 from its collapsed condition shown in FIG. 4 to its erect condition shown in FIG. 1, the aforementioned steps are simply repeated. In other words, the top 16 is pulled upwardly so that panels 50 and 51 extend in the same plane, and thereafter, the side panels 13 and 12 are pivoted about hinges 41 and 42 to extend normally or perpendicularly with respect to base panel 11. The top panel 16 is then pivoted downwardly so that abutments 58 and 59 abut the outside surfaces of braces 61 and 62. Thereafter, the latches 64 on side panels 12 and 13 are engaged with keepers 67 on the front panel 14, and the shelf 17 is lifted from base panel 11 and inserted into the slots 18. As with collapsing the cabinet 10, erecting the cabinet 10 may be performed while laying the cabinet on its side or front if the cabinet is relatively large.

The aforedescribed collapsible cabinet 10 provides a standard size cabinet for use where needed, for example for work benches, displays at trade shows and department stores, for catering or for beverage dispensing, which cabinet can be reduced substantially in volume or space consumed for the purpose of storage or transport.

While the panels 11, 12, 13, 14 and 16 of the afore-discussed embodiment are made of pressed board or plywood, they may be made of any available material. For example, the panels may be made of plastic. If the panels are made of plastic then the hinges 41, 42 and 43 can also be plastic and may be in the form of continuous flexible webs which are integrated with the panels.

The foregoing example is merely illustrative of one embodiment of the invention, which invention is to be limited only by the following claims.

I claim:

1. A foldable cabinet comprising:

a base panel extending horizontally for providing a floor for the cabinet when the cabinet is erected;

first flange means projecting upwardly from the base panel;

second flange means extending parallel with respect to said first flange means, being spaced therefrom and having a height greater than that of the first flange means;

third flange means extending perpendicular to said first and second flange means and extending upwardly from the base panel a distance greater than the second flange means;

a first side panel pivoted to said first flange means and pivotable between an upright position in which the side panel extends perpendicular to the base panel and a collapsed position in which the first side panel extends substantially parallel to the base panel, the first side panel having an inner surface and an outer surface;

a second side panel pivoted to the second flange means for movement between an erect position wherein the second side panel extends perpendicular to the base panel and collapse position in which the second side panel extends substantially parallel to the base in the overlapped relationship with respect to the first side panel, the first side panel having an inner surface and an outer surface;

a third side panel extending perpendicular to the first and second side panels and being pivoted to the third flange means for movement between an erect position wherein the third side panel extends normally with respect to the base panel means and a collapsed position in which the third side panel extends substantially parallel with respect to the base panel, the third side panel being divided into upper and lower portions by a hinge whereby upper portion overlies the lower portion when the thrid side panel is collapsed;

a top panel pivoted to the third side panel, the top panel extending perpendicularly with respect to the first, second, and third side panels and parallel to the base panel when the cabinet is erect and extending parallel to all panels when the cabinet is collapsed; the top panel having abutment means thereon for engaging the inner surfaces the side panels to prevent the side panels from collapsing inwardly when the cabinet is erect;

at least one shelf having a length substantially equal to the distance between the first and second panels when the cabinet is erect, the shelf having an absolute thickness no greater than the first flange means whereby the first side panel overlies the shelf when the shelf rests on the base panel for storage, and means for mounting the shelf intermediate the base panel and top panel when the cabinet is erect wherein the shelf serves as a stiffener which helps keep the first and second side panels erect, and latching means for latching the first and second side panels to the third side panel to keep the first and second side panels in engagement with the abutment means.

2. The foldable cabinet of claim 1 wherein the latching means comprises latch members pivoted on the inner surfaces of the first and second side panels adjacent to the mounting means for the shelf for engaging the lower portion of the third side panel.

3. The foldable cabinet of claim 2 wherein the cabinet includes one open side disposed opposite the third side panel wherein the top panel is supported only by the first, second and third side panels when the cabinet is erect, with the third side panel forming a front for the cabinet.

4. The foldable cabinet of claim 3 further including means on the base panel for allowing the cabinet to roll when in either the collapsed or erect condition.

5. The foldable cabinet of claim 4 further including a handle disposed on one of the first or second flange means.

* * * * *